US010835437B2

(12) United States Patent
Revenus

(10) Patent No.: US 10,835,437 B2
(45) Date of Patent: Nov. 17, 2020

(54) OPERATING-TABLE COLUMN

(71) Applicant: MAQUET GMBH, Rastatt (DE)

(72) Inventor: Rolf Revenus, Kuppenheim (DE)

(73) Assignee: MAQUET GMBH, Rastatt (DE)

( * ) Notice: Subject to any disclaimer, the term of this patent is extended or adjusted under 35 U.S.C. 154(b) by 615 days.

(21) Appl. No.: 15/647,365

(22) Filed: Jul. 12, 2017

(65) Prior Publication Data

US 2017/0304135 A1 Oct. 26, 2017

Related U.S. Application Data

(63) Continuation-in-part of application No. PCT/EP2016/050505, filed on Jan. 13, 2016.

(30) Foreign Application Priority Data

Jan. 15, 2015 (DE) ..... 10 2015 100 542

(51) Int. Cl.
*A61G 13/02* (2006.01)
*A61G 13/04* (2006.01)
(Continued)

(52) U.S. Cl.
CPC ..... *A61G 13/04* (2013.01); *A61G 13/06* (2013.01); *A61G 13/107* (2013.01)

(58) Field of Classification Search
CPC ..... A61G 13/02; A61G 13/04
(Continued)

(56) References Cited

U.S. PATENT DOCUMENTS 2,217,783 A * 10/1940 Bell ..... A61G 13/02 5/614
3,206,168 A 9/1965 Douglass
(Continued)

FOREIGN PATENT DOCUMENTS

DE 3815596 A1 11/1988
DE 102011000628 A1 8/2012
(Continued)

OTHER PUBLICATIONS

Chinese Office Action (with English translation) dated Jun. 22, 2018 for corresponding Chinese Patent Application No. 201680005816.0, 18 pages.
(Continued)

*Primary Examiner* — Fredrick C Conley
(74) *Attorney, Agent, or Firm* — Aaron M. Miller

(57) ABSTRACT

An operating table column is disclosed. The operating table column includes a column part and a head part configured to connect a patient support surface of an operating table to the column part. The operating table column also includes a power supply unit disposed on the column part for supplying power to the operating table. The head part includes a first head element mounted rotatably about a first rotation axis and a second head element mounted rotatably about a second rotation axis. The column part includes an actuator configured to lift the patient support surface. At least one tube is configured to connect the power supply to the operating table and is protected from exposure to external elements. The actuator includes a cover configured to guide a portion of the at least one tube at least partially through the first head element in an area adjacent to the first rotation axis.

20 Claims, 6 Drawing Sheets

(51) Int. Cl.
*A61G 13/06* (2006.01)
*A61G 13/10* (2006.01)

(58) Field of Classification Search
USPC ..... 5/613–618
See application file for complete search history.

(56) References Cited

U.S. PATENT DOCUMENTS

| | | | |
|---|---|---|---|
| 4,101,120 | A | 7/1978 | Seshima |
| 4,572,493 | A | 2/1986 | Hubert |
| 2002/0144349 | A1 | 10/2002 | Blyshak et al. |

FOREIGN PATENT DOCUMENTS

| | | | |
|---|---|---|---|
| GB | 728093 | A | 4/1955 |
| JP | 1978-020691 | | 2/1978 |
| JP | H02-180258 | A | 7/1990 |
| JP | 2005-500083 | A | 1/2005 |

OTHER PUBLICATIONS

International Search Report (completed Apr. 6, 2016—dated Apr. 13, 2016) which issued for corresponding international application PCT/EP2016/050505, 3 pages.
Japanese Office Action (with English translation) dated Nov. 5, 2019 during the prosecution of corresponding Japanese Patent Application No. 2017-535737, 4 pages.

* cited by examiner

OPERATING-TABLE COLUMN

CROSS REFERENCE TO RELATED APPLICATIONS

The present application is a continuation-in-part filed under 35 U.S.C. § 111(a), and claims the benefit under 35 U.S.C. §§ 365(c) and 371 of PCT International Application No. PCT/EP2016/050505, filed Jan. 13, 2016, which designates the United States of America, and claims benefit of German Patent Application No. 10 2015 100 542.5, filed Jan. 15, 2015. The disclosure of each of these applications is incorporated by reference herein in its entirety.

TECHNICAL FIELD

The present disclosure relates to operating table columns for supporting a patient support surface of an operating table. In particular, the present disclosure relates to operating table columns having a power source for supplying power to an adjustable operating table.

BACKGROUND

Conventional operating tables may often utilize an operating table column having a column part, a power supply unit arranged on the column part, and a head part for connecting a patient support surface of the operating table to the column part. With conventional operating table columns, for example, the head part of the column can be rotated about both inclination and tilt axes within the head part to incline and tilt the head part and, therefore, the patient support surface of the operating table.

For example, FIGS. 4 and 5 of the present application illustrate an exemplary operating table column of the prior art (i.e., a conventional operating table column). FIGS. 4 and 5 each show a side view of the conventional operating table column. As illustrated in FIGS. 4 and 5, the conventional operating table column comprises a column base, a column part 10 connected to the column base, a head part 14 intended for connection to a patient support surface of the operating table, and a plurality of actuating drives 16, 18, 20 that support the head part 14. Each of the drives has a first element, e.g., the cylinder 36, 52, 64, and a second element, e.g., the piston rod 40, 56, 68, which can be linearly adjusted relative to the first element and acts on the head part 14. The conventional operating table column shown in FIGS. 4 and 5 further includes clamps 38, an articulation head 42, universal joints 66, 70, and axes 54, 62.

In conventional operating tables with high adjustment capability, i.e. with an inclination of >20° and a tilt of >15°, such as those shown in FIGS. 4 and 5, power is supplied between the patient support surface on the head part 14 and the power supply unit near the cylinder 36 with the aid of tubing (not shown), which is located outside of the side paneling of the column. The tubing with the power-carrying cables is a flexible tube, which is routed via connection fittings S in a U-shape between components 14 and 36. More particularly, the tubing (which is not shown in FIGS. 4 and 5) is routed in an exposed manner, outside of side paneling that is attached to the column part 10. The tubing is thus exposed to soiling from surgical procedures and must be cleanable. The cleanability requirement of the tubing also places very high and costly demands on the tubing material and on the connection fittings S to permit fastening of the tube in a fluid-tight manner. Moreover, the required cleaning is time-consuming for the surgical staff.

Accordingly, the conventional operating table column shown in FIGS. 4 and 5 has various disadvantages. Due to the high adjustment capability of the head part 14 and the above geometric positioning of the tube outside of the pivot points and axes 54 and 70 of the joint in question, a relatively long tube is required to compensate for the various movements, i.e., the inclination and/or tilting movement of the head part 14. The cleanability requirement of the tubing also necessitates a relatively thick tube with adverse bending radii. Thus, the large number of complex components makes this known solution cost-intensive. Furthermore, the outlet openings can be sealed only with great effort.

FIG. 6, for example, shows a schematic diagram illustrating some of the above-noted disadvantages of a conventional operating table column, such as the exemplary conventional operating table column illustrated in FIGS. 4 and 5. In FIG. 6, a known operating table column with lifting guide 1 and lifting cylinder 2 is schematically illustrated. Lifting guide 1, which surrounds lifting cylinder 2, comprises at least two tubes inserted into one another as sliding thrust tubes. Lifting cylinder 2 makes maximum use of the height of lifting guide 1 to achieve the necessary adjustment length. With the known operating table column, the power supply is provided by a power supply unit 3, which is attached to the uppermost column element of lifting guide 1. Patient support surface 4 is then connected to power supply unit 3 by a movable, tubular power line guide 5. Power line guide 5 is typically formed from a flexible tube filled with electric or hydraulic power lines.

As illustrated in FIG. 6, power line guide 5 is arranged in a U-shape between the lifting guide 1 and the patient support surface 4, as this is the only advantageous installation space for the final product. More particularly, with the known operating table column, inclination axis 6 and tilt axis 7 are arranged above lifting guide 1 to provide the necessary installation space for power line guide 5 or for the tube, which has a tube diameter of 30 to 45 mm. Thus, a disadvantage of this known solution is that an overall height $I_1$ of at least 165 mm is required between the patient support surface 4 and the lifting guide 1 to accommodate the U-shaped tubular sheath. In such an arrangement, inclination axis 6 and tilt axis 7 are typically spaced from the lifting guide 1 by a distance $I_2$ of 100 mm. The inclination and/or tilting movement of the patient support surface 4 are also indicated schematically in FIG. 6 by arrows 8.

SUMMARY OF THE DISCLOSURE

The present disclosure provides an operating table column that may overcome some of the disadvantages discussed above by, for example, permitting power to be supplied to an operating table in a simple and space-saving manner.

In accordance with the present disclosure, an operating table column may include a column part and a head part. A power supply unit is arranged on the column part. The head part comprises a first head element, which is mounted rotatably about a first rotation axis, and a second head element, which is mounted rotatably about a second rotation axis. The column part comprises an actuator for effecting a lifting movement of the patient support surface. The actuator further comprises a cover, which is configured such that at least one tube connected to the power supply unit can be guided at least partially through the first head element in an area adjacent to the first rotation axis. The use of a relatively long, cleanable tube for the power supply can thereby be avoided. As a result, the operating table can be supplied with power in a simple and space-saving manner.

In accordance with one aspect of the present disclosure, the cover of the actuator may extend along the first rotation axis between two opposing sides of the column part. For example, in one exemplary embodiment it is contemplated that a radial extension of the area adjacent to the first rotation axis is less than about one-half of a radial distance between a first frame section of the first head element and the first rotation axis. In one example, this distance may be less than about one-quarter of a radial distance between a first frame section of the first head element and the first rotation axis. This allows a relatively small area to be provided near the first rotation axis, in which the tube for the power supply (e.g., to the operating table) can then be guided.

Additionally or alternatively, the cover of the actuator may include at least one recess for guiding the tube in the area adjacent to the first rotation axis. This may, for example, allow the tube to pass relatively close to the first rotation axis and into the head part. For example, the cover of the actuator may comprise two recesses for respectively guiding two tubes in the area adjacent to the first rotation axis, each tube being connected to the power supply unit, with the two recesses facing the two opposing sides of the column part. Each recess may have a rectangular profile. This may allow multiple tubes for supplying power (e.g., to the operating table) to be provided, with each tube being guided in the area adjacent to the first rotation axis.

In accordance with various exemplary embodiments of the present disclosure, a radial extension of the area adjacent to the first rotation axis may be between about 15 mm and about 35 mm, such as, for example, between about 15 mm and about 20 mm. This may, for example, give the relatively small area (e.g., the area adjacent to the first rotation axis) dimensions that are suitable for guiding the tube near the first rotation axis.

In accordance with the present disclosure, the first head element may be configured such that the tube can be guided all the way through the first head element in the area adjacent to the first rotation axis and in an additional area adjacent to the second rotation axis. This may allow the tube to be guided within the head part not only in the area near the first rotation axis, but also in an additional area near the second rotation axis. For example, a radial extension of the area adjacent to the second rotation axis may be less than about one-half a radial distance between a second frame section of the first head element and the second rotation axis. This may allow a relatively small additional area to be provided near the second rotation axis, in which the tube for supplying power (e.g., to the operating table) can then be guided.

The first head element may comprise at least one recess having a round profile for guiding the tube in the area adjacent the second rotation axis. This may allow the tube to be guided within the head part relatively close to the second rotation axis.

In accordance with another aspect of the present disclosure, the first head element and the second head element may be configured such that, when the second head element executes a tilting movement around the second rotation axis, the tube is prevented from being crushed in the area adjacent to the second rotation axis. This may enable the tube to be guided safely within the head part during a tilting movement of the second head element.

The tilting movement of the second head element relative to the first head element may occur, for example, within an angular range of about 0° to about 25°. In one exemplary embodiment of the present disclosure, the first head element and the second head element may form a Cardan joint. In that case, the first rotation axis and the second rotation axis may lie in two parallel planes arranged one above the other. The two parallel planes arranged one above the other may be spaced from one another by a maximum of about 60 mm. A Cardan joint can thus be provided for a very reliable functioning of the head part.

In various further embodiments, the column part and the power supply unit may be covered by side paneling, and the section of tube that extends along the column part may be routed entirely within the side paneling. The tube section may, therefore, be fully protected by the side paneling. As a result, no additional protective tubing is required for covering the tube section. Furthermore, the tube section that is routed entirely within the side paneling does not require elaborate cleaning.

In accordance with another aspect of the present disclosure, the second head element may form a housing for covering the section of tube that can be guided at least partially through the first head element. This tube section may thus be encompassed completely by the housing that is formed by the second head element.

In accordance with the present disclosure, the column part may further comprise a lifting guide and a telescoping assembly, which is integrated into the lifting guide and comprises at least two column elements that are movable relative to one another. The lifting guide comprises a window, located above the two column elements that are movable relative to one another, for guiding the tube section that extends along the column part from the outside of the column part to the inside of the column part. In this way, the movable column elements of the telescoping assembly may be prevented from shearing the tube. This may give the operating table column a sturdy construction.

Additional objects and advantages will be set forth in part in the description which follows, and in part will be obvious from the description, or may be learned by practice of the present disclosure. The objects and advantages may be realized and attained by means of the elements and combinations particularly pointed out in the appended claims and their equivalents.

It is to be understood that both the foregoing general description and the following detailed description are exemplary and explanatory only and are not restrictive of the present disclosure and claims.

BRIEF DESCRIPTION OF THE DRAWINGS

Additional features and advantages of the present disclosure will be apparent from the following description, which further details the present disclosure with reference to exemplary embodiments, in conjunction with the accompanying figures. The drawings show.

DETAILED DESCRIPTION AND INDUSTRIAL APPLICABILITY

Figure 1:
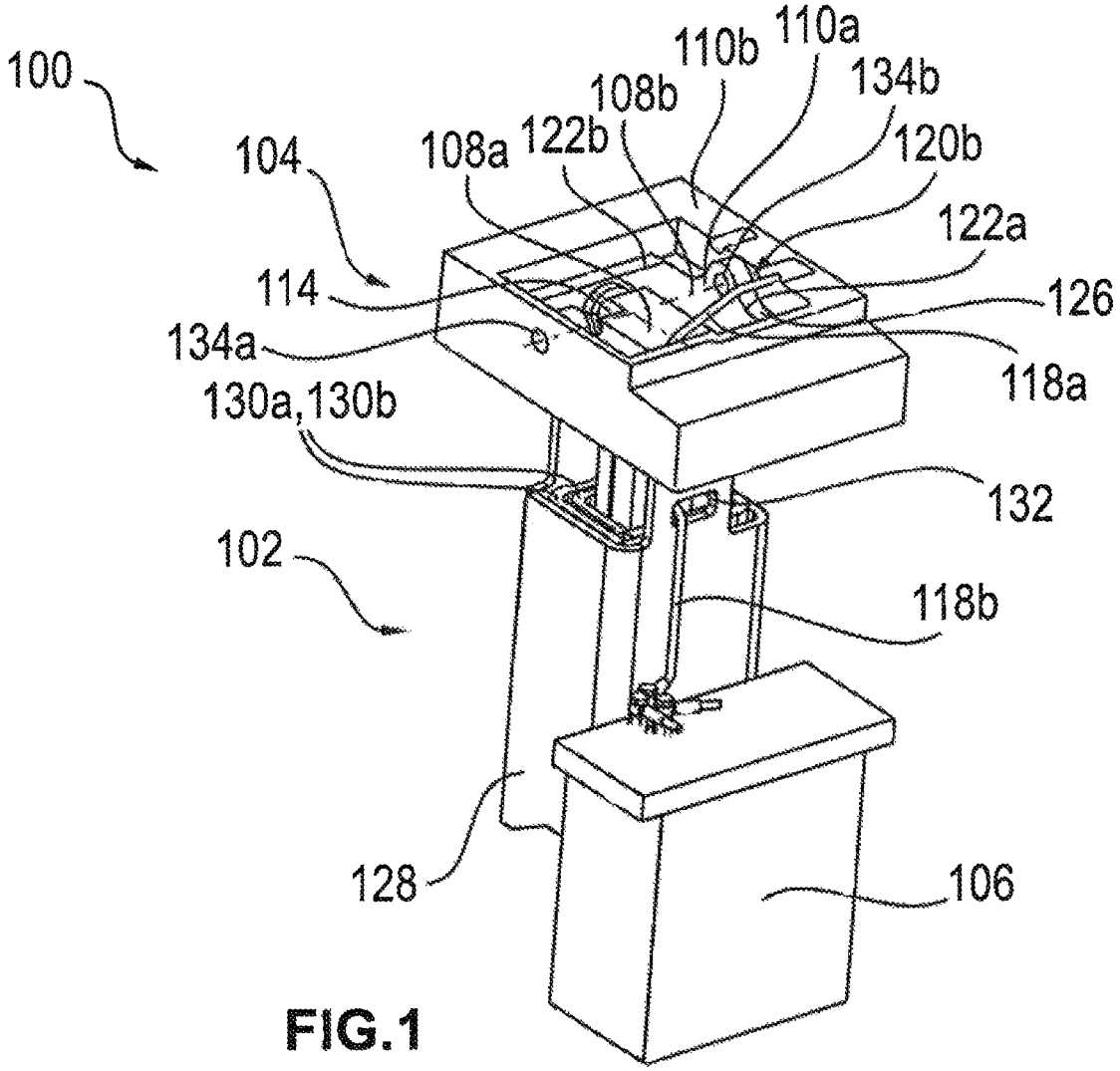
FIG. 1 is a perspective view of an operating table column according to an exemplary embodiment of the present disclosure.

FIG. 1 shows a perspective view of an operating table column 100 according to an exemplary embodiment of the present invention. As illustrated in FIG. 1, the operating table column 100 comprises a column part 102, a power supply unit 106 disposed on the column part 102, and a head part 104. Head part 104 comprises a first head element 110*a*, which is mounted rotatably about a first rotation axis 108*a*, and a second head element 110*b*, which is mounted rotatably about a second rotation axis 108*b*. The first head element 110*a* is mounted on column part 102 to rotate about the first rotation axis 108*a*. Further, the second head element 110*b* is mounted on the first head element 110*a* to rotate about the second rotation axis 108*b*.

In the exemplary embodiment shown in FIG. 1, the first head element 110*a* and the second head element 110*b* form a Cardan joint for a gimbal mounting of the second head element 110*b* on the column part 102. As illustrated in FIG. 1, the first rotation axis 108*a* and the second rotation axis 108*b* lie in two parallel planes arranged one above the other. These planes are parallel to an upper surface of head part 104 in its home position. The two parallel planes arranged one above the other are spaced by a maximum of about 60 mm. This relatively small height difference, therefore, enables a very secure gimbal mounting of the second head element 110*b* on the column part 102.

As further illustrated in FIG. 1, the first head element 110*a* comprises a rectangular frame having a first frame section 122*a* and a second frame section 122*b*. The first frame section 122*a* extends parallel to the first rotation axis 108*a*, whereas the second frame section 122*b* extends parallel to the second rotation axis 108*b*. As FIG. 1 further shows, the first rotation axis 108*a* and the second rotation axis 108*b* are perpendicular to one another when projected onto a common plane. In this manner, the first rotation axis 108*a* corresponds to an inclination axis during an inclining movement of the first head element 110*a*. And, the second rotation axis 108*b* corresponds to a tilt axis during a tilting movement of the second head element 110*b*. As illustrated in FIG. 1, the second head element 110*b* also comprises a rectangular frame. This frame (e.g., of second head element 110*b*) surrounds the frame sections 122*a*, 122*b* of the first head element 110*a*.

As shown in FIG. 1, the second head element 110*b* comprises a through hole 134*a* in a frame section disposed opposite the first frame section 122*a* of the first head element 110*a*. Although not visible in the orientation of FIG. 1, the first head element 110*a* also comprises a through hole 134*b* in the first frame section 122*a*. As illustrated in FIG. 1, the second rotation axis 108*b* extends centrally through the through-holes 134*a*, 134*b*. Through holes 134*a*, 134*b* are configured to receive a rotary element, which is mounted rotatably in the through holes 134*a*, 134*b* and is fixedly connected to the second head element 110*b*. This enables the tilting movement of the second head element 110*b* relative to first head element 110*a*.

In the exemplary embodiment shown in FIG. 1, the column part 102 comprises a lifting guide 128 and two column elements 130*a*, 130*b* that are movable relative to one another. These two column elements 130*a*, 130*b* are movable parallel to a longitudinal axis of the column part 102, e.g., vertically. The two column elements 130*a*, 130*b* (which are movable relative to one another) form a telescoping assembly, which is integrated into the lifting guide 128. The telescoping assembly serves to adjust the height of the operating table column 100.

The power supply unit 106 comprises at least one tube 118 (one tube 118 being shown in the exemplary embodiment of FIG. 1), which is connected to the power supply unit 106, for supplying power to an operating table. The tube 118 has a first tube section 118*a* and a second tube section 118*b*. As shown in FIG. 1, the first tube section 118*a* extends substantially through the head part 104, whereas the second tube section 118*b* extends along the column part 102. The power supply unit 106 may include, for example, a hydraulic unit. The tube 118, and hence tube sections 118*a*, 118*b*, may comprise a plurality of electric and/or hydraulic lines. As illustrated in FIG. 1, the second tube section 118*b* can be guided, for example, through a window 132 located above the two column elements 130*a*, 130*b* that are movable relative to one another. Window 132 is provided in lifting guide 128 of column part 102.

As above, the operating table column 100 of FIG. 1 is configured such that the first tube section 118*a* (e.g., after the second tube section 118*b* is guided through the window 132) can be guided through the head part 104 in a first area 120*a* adjacent to the first rotation axis 108*a* and in a second area 120*b* adjacent to the second rotation axis 108*b*. The second area 120*b* adjacent to the second rotation axis 108*b* is visible in FIG. 1. As illustrated in the embodiment of FIG. 1, this second area 120*b* is formed by a recess 126 in the first frame section 122*a* of first head element 110*a*. Recess 126 further comprises a round profile, for example, the height of which decreases monotonically as the radial distance from the second rotation axis 108*b* increases. In this manner, the recess 126 may guide the first tube section 118*a* through the head part 104 to prevent this section of the tube 118 (e.g., the first tube section 118*a*) from being crushed during a tilting movement of the second head element 110*b* about the second rotation axis 108*b*. In accordance with various embodiments, for example, the tilting movement of the second head element 110*b* relative to the first head element 110*a* is carried out within an angular range of about 0° to about 25°. As used herein, an angle of 0° corresponds to a home position of the head part 104, as shown in FIG. 1, in which first head element 110*a* and second head element 110*b* are each aligned perpendicular to a longitudinal axis of column part 102.

Figure 2:
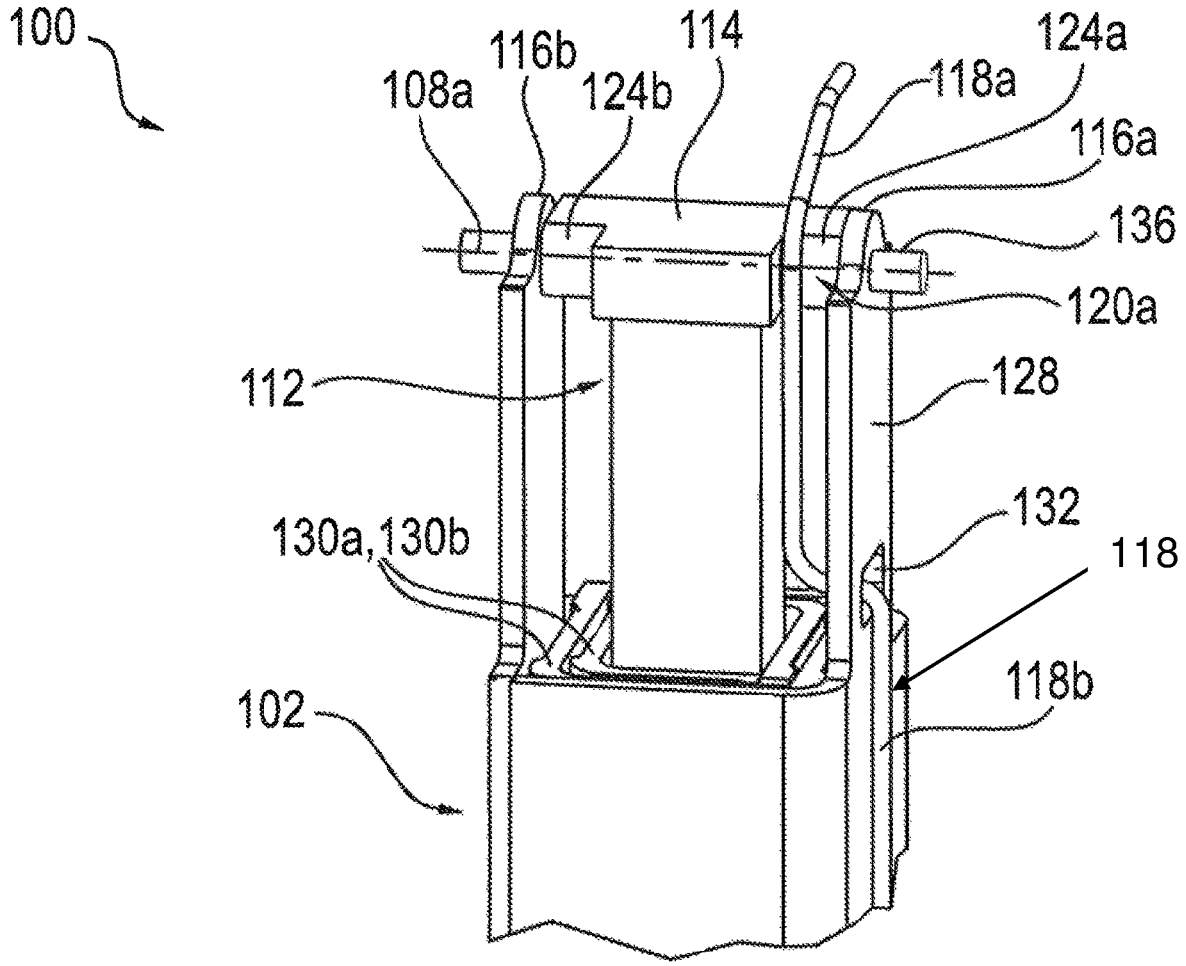
FIG. 2 is a perspective view of the column part of the operating table column shown in FIG. 1.

FIG. 2 shows a perspective view of the column part 102 of the operating table column 100 of FIG. 1. The first area 120*a* is visible adjacent to the first rotation axis 108*a* in FIG. 2. As shown in FIG. 2, the column part 102 includes an actuator 112 with a cover 114. The cover 114 extends along the first rotation axis 108*a* between opposing sides 116*a*, 116*b* of the column part 102. The first rotation axis 108*a* extends centrally through a pivot pin 136 held in an upper region of the column part 102. The pivot pin 136 extends through opposing holes in each of the two opposing sides 116*a*, 116*b* of the column part 102 and through the cover 114 of the actuator 112. The pivot pin 136 is also mounted rotatably on the column part 102 and is fixedly connected to the first head element 110*a*. This allows an inclining movement of the first head element 110*a* relative to the column part 102. The actuator 112, as shown in FIG. 2, may be used, for example, for height adjustment or for carrying out a lifting movement of the operating table column 100.

As shown in FIG. 2, the cover 114 of the actuator 112 comprises two recesses 124*a*, 124*b* each having a rectangular profile. The two recesses 124*a*, 124*b* face the two opposing sides 116*a*, 116*b* of the column part 102. The two recesses 124*a*, 124*b* may, for example, serve to guide respective tubes 118 that are connected to the power supply unit 106 in the first area 120*a* located adjacent to the first rotation axis 108*a*. Various embodiments of the present disclosure, for example, contemplate guiding multiple tubes 118 that are connected to the power supply unit 106 in the area adjacent to the first rotation axis 108*a*.

As illustrated in the embodiment of FIG. 2, for example, a first tube section 118*a* of a first tube 118 is guided by a first recess 124*a* and extends in the first area 120*a* adjacent to the first rotation axis 108*a*. Although not shown in FIG. 2, in the same manner a first tube section 118*a* of a second tube 118 may be guided by a second recess 124*b* to also extend in an area adjacent to the first rotation axis 108*a*. Additionally or alternatively, it is contemplated that a second window 132 may be provided on an opposite side of column part 102 to guide the second tube. Referring to FIGS. 1 and 2, the first tube section 118*a* can be guided all the way through the first head element 110*a*, both in the first area 120*a* adjacent to the first rotation axis 108*a* and in the second area 120*b* adjacent to the second rotation axis 108*b*, by using the recess 124*a* of the cover 114 and the recess 126 of the first head element 110*a*. Furthermore, first tube section 118*a* can also be guided through the second head element 110*b* and thus through the entire head part 104. In this manner, the first tube section 118*a* extends within the column part 102 to an area adjacent to the first rotation axis 108*a* and an area adjacent to the second rotation axis 108*b* such that the first and second head elements 110*a*, 110*b* shield the first tube section 118*a* during movement of the head part. Thus, the first head element 110*a* and the second head element 110*b* are each configured to prevent the first tube section 118*a* from being crushed by a tilting movement of the second head element 110*b* around the second rotation axis 108*b* in the area adjacent the second rotation axis 120*b* as the first and second head elements 110*a*, 110*b* form a protective space within which the first tube section 118*a* is positioned.

In accordance with various embodiments of the present disclosure, with the rectangular profile of recesses 124*a*, 124*b*, a radial extension of the first area 120*a* may correspond, for example, to a radial distance between a lateral edge of the cover 114 and the first rotation axis 108*a*. Furthermore, the recesses 124*a*, 124*b* of the cover 114 and the recess 126 of the first head element 110*a* can be dimensioned such that the first area 120*a* and the second area 120*b* form relatively small areas, having a small radial extension around the first rotation axis 108*a* and the second rotation axis 108*b*, respectively. In other words, the radial extension of the first area 120*a* may be relatively small as compared with the radial distance between the first frame section 122*a* of first head element 110*a* and the first rotation axis 108*a*. Further, the radial extension of the second area 120*b* may be relatively small as compared with the radial distance between the second frame section 122*b* of the first head element 110*a* and the second rotation axis 108*b*.

The second tube section 118*b*, which has been guided through window 132, is also clearly visible in FIG. 2. As shown in FIG. 2, the tube section 118*b* is guided from the outside of the column part 102 to the inside of the column part 102. The two column elements 130*a*, 130*b* that are movable relative to one another in the telescoping assembly, which is integrated into lifting guide 128, cannot be moved to a position level with or above window 132. For example, in one exemplary embodiment, column elements 130*a*, 130*b* can only be moved downward relative to the window 132, which is arranged there above. Such an arrangement prevents the second tube section 118*b* (which is guided through the window 132) from being sheared off by movement of the elements 130*a* and 130*b* relative to each other.

Figure 3:
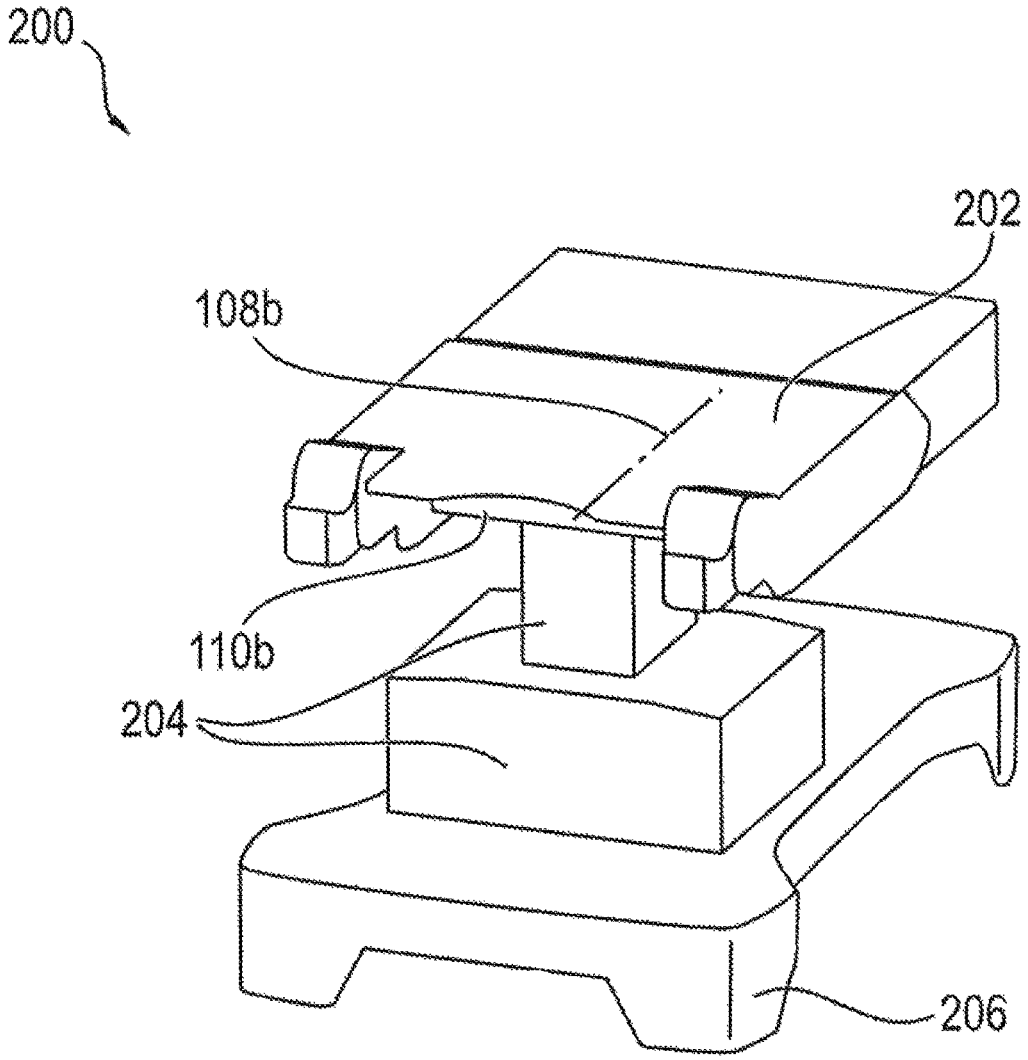
FIG. 3 is a perspective view of an exemplary embodiment of an operating table having the operating table column shown in FIG. 1.
Figure 4:
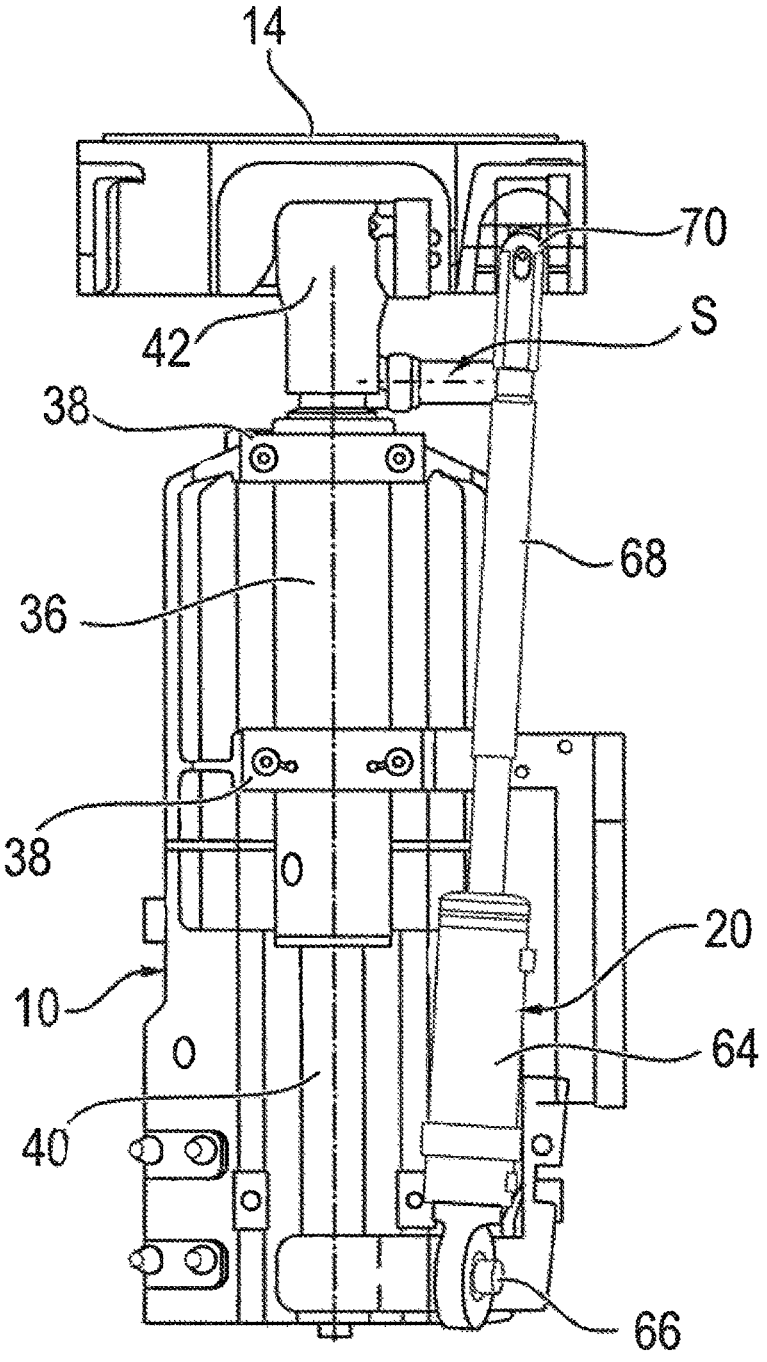
FIG.4 (PRIOR ART)
FIGS. 4 and 5 show side views of a conventional operating table column according to the prior art.
Figure 5:
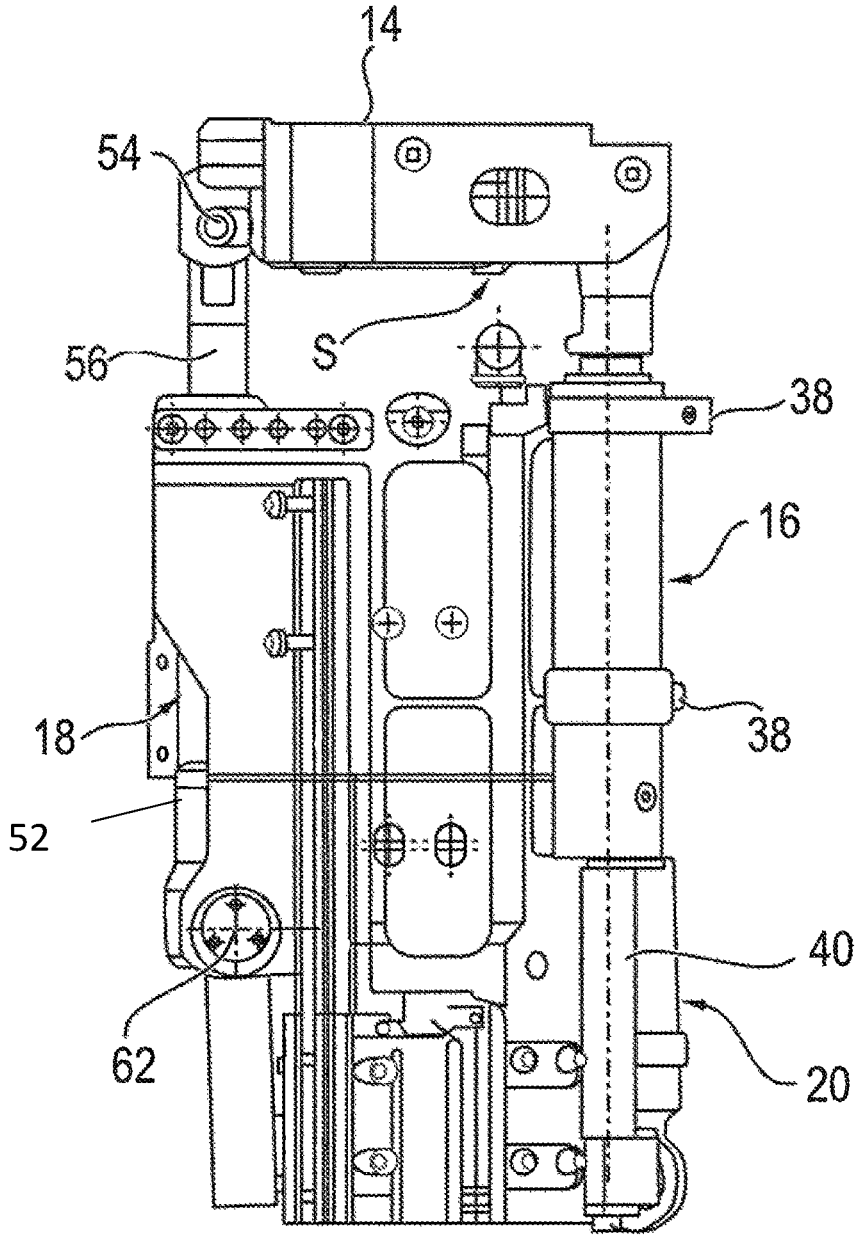
FIG.5 (PRIOR ART)
Figure 6:
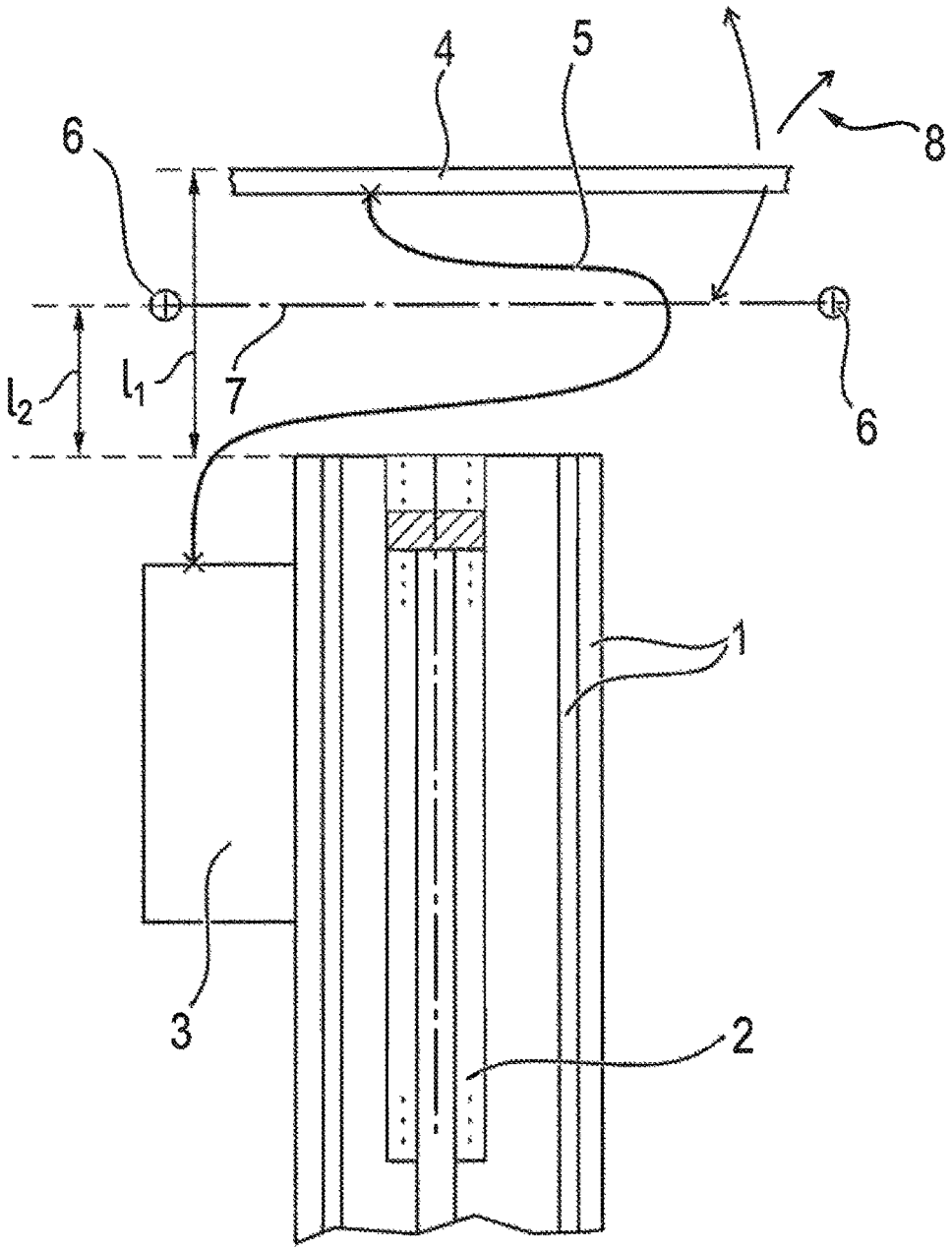
FIG.6 (PRIOR ART)
FIG. 6 shows a schematic diagram of a conventional operating table column of the prior art.

FIG. 3 shows a perspective view of an operating table 200 incorporating the operating table column 100 of FIG. 1. In the orientation shown, only the second head element 110*b* of the operating table column 100 is partially visible. As illustrated in FIG. 3, the column part 102 and the power supply unit 106 of operating table column 100, which is disposed on the column part 102, are covered by side paneling 204. The components of the operating table column 100 that are covered by the side paneling 204 are supported by a base 206 of the operating table 200. With reference to FIGS. 1 and 3, the head part 104 of the operating table column 100 serves to connect a patient support surface 202 of the operating table 200 to the column part 102. The second rotation axis 108*b*, which extends within the head part 104, is shown in FIG. 3. During a tilting movement of the second head element 110*b* about the second rotation axis 108*b*, the patient support surface 202 is moved about this axis. The lifting movement of the patient support surface 202 is effected by the actuator 112 of operating table column 100.

In the orientation of FIGS. 1 and 3, the tube 118, comprising tube sections 118*a* and 118*b*, extends upward from the power supply unit 106 in the direction of the patient support surface 202, and is covered completely by a housing formed by the second head element 110*b* and by the side paneling 204. That is, a first tube portion 118*a* of tube 118 is protected from exposure to external elements by an interior of the column part and the head part (see FIG. 2) and the remainder of the tube 118 (tube section 118*b*) is protected from exposure to external elements by a covering (e.g., side paneling 204) that encloses the power supply unit and column part (see FIG. 3). This configuration allows the operating table 200 to be used in a robust manner, without the use of additional protective tubing. Furthermore, since the tube 118 is completely covered and is not opening exposed to soiling during a surgical procedure, it does not require elaborate cleaning upon completion of the procedure.

The present disclosure further provides a unique arrangement of the tube section 118*a* adjacent to the first rotation axis 108*a*, also referred to as the inclination axis, and adjacent to the second rotation axis 108*b*, also referred to as the tilt axis. This arrangement enables a relatively short routing of the tube section 118*a*. Furthermore, the arrangement of the Cardan joint, with a maximum height difference of about 60 mm between the tilt axis 108*b* and the inclination axis 108*a* may result in a very reliable operating table column.

In summary, operating table columns in accordance with the present disclosure, such as, for example, the operating table column 100 may provide various advantages. Firstly, at least one recess 126 may be provided in the first head element 110*a*, so that during an adjusting movement of the second head element 110*b* about the tilt axis 108*b*, the tube section 118*a* is prevented from being crushed. In other words, the specially shaped frame section 122*a* of the first head element 110*a* allows for unhindered movement of the second head element 110*b* at an angle (e.g., about the horizontal position of the tilt axis 108*b*) of about 0° to about 25°. Additionally, the arrangement of the at least one tube 118 makes it possible to route each tube section of tube 118 within the side paneling. In contrast, this is not possible with known operating tables. In conventional operating table columns, lines must typically be sheathed inside a bellows or protective tubing if high adjustment capabilities are to be achieved. In accordance with the present disclosure, however, the covering function is performed, for example, by the housing formed by the second head element 110*b*, which also bears the load of the patient support surface 202. Furthermore, the window 132 is positioned at a height such that the side paneling 204 completely covers the window 132. In this manner, the tube sections 118*a*, 118*b* can be routed beneath the side paneling 204 from the power supply unit 106, through the window 132 within the outer lifting guide 128, through the recesses 124*a*, 124*b* on both sides to be adjacent the first rotation axis 108*a*. The position of the window 132 at the height according to the present disclosure servers to protect the tube sections from being sheared off by the movable column elements 130*a*, 130*b* of the telescoping assembly that is integrated into the lifting guide 128. According to various embodiments of the present disclosure, the at least one recess 124*a* is positioned in the cover 114 of the actuator 112, which is provided for the lifting drive. In this manner, no design height is sacrificed in order to achieve this advantageous arrangement. With known operating tables, in contrast, at least 40 mm of vertical installation space is sacrificed for the flexible routing of the tube between the patient support surface and the housing of the head part.

Thus, the present disclosure provides for a tube that is not exposed and does not require an extra cleaning process, which results in a more cost-effective power supply to the operating table (e.g., since electric cables and pressure hoses can be used without costly precautionary measures such as protective tubing). While the present teachings have been disclosed in terms of exemplary embodiments in order to facilitate a better understanding, it should be appreciated that the present teachings can be embodied in various ways without departing from the scope thereof. Therefore, the present disclosure should be understood to include all possible embodiments which can be embodied without departing from the scope of the disclosure set out in the appended claims.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the written description and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It will be apparent to those skilled in the art that various modifications and variations can be made to the operating table columns of the present disclosure without departing from the scope of the disclosure. Other embodiments of the disclosure will be apparent to those skilled in the art from consideration of the specification and practice of the teachings disclosed herein. It is intended that the specification and embodiments described herein be considered as exemplary only.

I claim:

1. An operating table column, comprising:

a column part;

a head part configured to connect a patient support surface of an operating table to the column part, the head part including a first head element mounted rotatably about a first rotation axis and a second head element mounted rotatably about a second rotation axis;

wherein the column part includes an actuator configured to lift the patient support surface and a power supply unit for supplying power to the operating table, wherein the actuator includes a cover configured to guide at least one tube that is connected to the power supply unit at least partially through the first head element in an area adjacent to the first rotation axis;

wherein a radial extension of the area adjacent to the first rotation axis is less than about one-half of a radial distance between a first frame section of the first head element and the first rotation axis.

2. The operating table column of claim 1, wherein the first head element and the second head element form a Cardan joint, and wherein the first rotation axis and the second rotation axis lie in two parallel planes arranged one above the other.

3. The operating table column of claim 1, wherein the cover includes at least one recess for guiding the at least one tube in the area adjacent to the first rotation axis.

4. The operating table column of claim 3, wherein the cover includes two recesses, each recess configured to guide a tube in the area adjacent to the first rotation axis, wherein the two recesses are positioned to face opposing sides of the column part.

5. The operating table column of claim 4, wherein each recess has a rectangular profile.

6. The operating table column of claim 1, wherein the radial extension of the area adjacent to the first rotation axis is between 15 mm and 35 mm.

7. The operating table column of claim 1, wherein the first head element is configured to guide the at least one tube through the first head element in the area adjacent to the first rotation axis and in an area adjacent to the second rotation axis.

8. The operating table column of claim 7, wherein a radial extension of the area adjacent to the second rotation axis is less than about one-half a radial distance between a second frame section of the first head element and the second rotation axis.

9. The operating table column of claim 7, wherein the first head element has at least one recess with a round profile for guiding the at least one tube in the area adjacent to the second rotation axis.

10. An operating table system, comprising:

an operating table including a patient support surface;

the operating table column according to claim 1; and a power supply unit disposed on the column part of the operating table column, the power supply unit including at least one tube extending from the power supply unit to the operating table for supplying power to the operating table, wherein a first portion of the at least one tube is protected from exposure to external elements by the column part and the head part, and a remainder of the at least one tube is protected from exposure to external elements by a covering that encloses the power supply unit and column part.

11. The operating table system of claim 10, wherein the head part of the operating table column includes a first head element mounted rotatably about a first rotation axis, and wherein the actuator includes a cover having at least one recess configured to guide the first portion of the at least one tube at least partially through the first head element in an area adjacent to the first rotation axis.

12. An operating table column, comprising:

a column part;

a head part configured to connect a patient support surface of an operating table to the column part, the head part including a first head element mounted rotatably about a first rotation axis and a second head element mounted rotatably about a second rotation axis; and a power supply unit disposed on the column part, the power supply unit including at least one tube for supplying power to the operating table, wherein a first portion of the at least one tube extends within the column part to an area adjacent to the first rotation axis and an area adjacent to the second rotation axis such that the first and second head elements shield the first portion of the tube during movement of the head part;

wherein the first head element and the second head element form a Cardan joint, wherein the first rotation axis and the second rotation axis lie in two parallel planes arranged one above the other, and wherein the maximum distance between the two parallel planes arranged one above the other is 60 mm.

13. An operating table system, comprising:

an operating table including a patient support surface;

the operating table column according to claim 12; and a power supply unit disposed on the column part of the operating table column, the power supply unit including at least one tube extending from the power supply unit to the operating table for supplying power to the operating table, wherein a first portion of the at least one tube is protected from exposure to external elements by the column part and the head part, and a remainder of the at least one tube is protected from exposure to external elements by a covering that encloses the power supply unit and column part.

14. The operating table column of claim 12, wherein the column part and the power supply unit are covered by paneling, and wherein a second portion of the at least one tube extends from the power supply unit along the column part and entirely within the paneling.

15. The operating table column of claim 12, wherein the first and second head elements form a protective space within which the first portion of the at least one tube is positioned.

16. The operating table column of claim 12, further comprising paneling on an exterior of the column part, wherein an entire length of the at least one tube is protected from exposure to external elements by at least one of the paneling and the head part.

17. The operating table column of claim 12, wherein the column part further includes a lifting guide and a telescoping assembly, which is integrated into the lifting guide and which has at least two column elements that can be moved relative to one another, and wherein the lifting guide has a window positioned above the two column elements, wherein the first portion of the at least one tube enters the column part through the window.

18. The operating table column of claim 12, wherein the first head element and the second head element are each configured to prevent the first portion of the at least one tube from being crushed by a tilting movement of the second head element around the second rotation axis in the area adjacent the second rotation axis.

19. The operating table column of claim 18, wherein the tilting movement of the second head element relative to the first head element occurs within an angular range of about 0° to about 25°.

20. An operating table column, comprising:

a column part;

a head part configured to connect a patient support surface of an operating table to the column part, the head part including a first head element mounted rotatably about a first rotation axis and a second head element mounted rotatably about a second rotation axis;

wherein the column part includes an actuator configured to lift the patient support surface and a power supply unit for supplying power to the operating table, wherein the actuator includes a cover configured to guide at least one tube that is connected to the power supply unit at least partially through the first head element in an area adjacent to the first rotation axis;

wherein the first head element is configured to guide the at least one tube through the first head element in the area adjacent to the first rotation axis and in an area adjacent to the second rotation axis; and wherein a radial extension of the area adjacent to the second rotation axis is less than about one-half a radial distance between a second frame section of the first head element and the second rotation axis.

* * * * *